United States Patent [19]

Regalbuto

[11] 4,172,421

[45] Oct. 30, 1979

[54] FLUID DESENSITIZED SAFE/ARM DETONATOR ASSEMBLY

[75] Inventor: John A. Regalbuto, Fort Worth, Tex.

[73] Assignee: Jet Research Center, Inc., Arlington, Tex.

[21] Appl. No.: 891,668

[22] Filed: Mar. 30, 1978

[51] Int. Cl.[2] ..... F42C 15/34

[52] U.S. Cl. ..... 102/20; 102/254; 102/260; 166/55.1

[58] Field of Search ..... 166/55.1; 175/2, 4.6, 175/4.56; 89/1 C; 102/20, 222, 254, 260

[56] References Cited

U.S. PATENT DOCUMENTS

| | | | |
|---|---|---|---|
| 2,666,388 | 1/1954 | Wheeler | 102/254 |
| 2,924,173 | 2/1960 | Robertson | 89/1 C X |
| 2,994,272 | 8/1961 | Saunderson | 102/254 |
| 3,311,058 | 3/1967 | Fohrmann et al. | 102/254 |
| 3,323,460 | 6/1967 | Bliss | 102/254 |
| 3,547,033 | 12/1970 | Gawlick et al. | 102/254 |
| 4,011,815 | 3/1977 | Garcia | 102/20 |

*Primary Examiner*—David H. Brown
*Attorney, Agent, or Firm*—Floyd A. Gonzalez; John H. Tregoning; Thomas R. Weaver

[57] ABSTRACT

Disclosed is a safe/arm detonator assembly for use with an oil well perforating gun assembly having two housing members sealingly isolated from well bore fluid and which are rotatable from a safe position wherein a detonator and a booster are held out of alignment, to an armed position wherein the detonator and booster are moved into alignment. The detonator assembly is further arranged to be installed in a well perforating gun assembly such that the gun assembly may be transported with the detonator assembly in the safe position, and rotated to the armed position at the well site without disassembling the gun assembly. A safety pin is further disclosed which may be included in one of the housing members to cover and protect the booster from accidental detonation when the detonator assembly is in the safe position.

14 Claims, 5 Drawing Figures

FLUID DESENSITIZED SAFE/ARM DETONATOR ASSEMBLY

BACKGROUND AND SUMMARY OF THE INVENTION

This invention is related to apparatus for perforating oil wells, and is more particularly related to a detonator assembly for initiating oil well perforator units in a perforating gun assembly.

As is known in the art, perforating gun assemblies are used in the production of oil and gas when it is desired to provide perforations through an oil well casing and into a hydrocarbon producing formation to provide access from the formation into the well bore such that oil and gas may be produced.

After the oil well has been drilled, a steel casing is lowered into the well bore and cemented into place to protect the well bore and to prevent migration of formation fluid from one formation to another.

A perforating gun is then lowered into the steel casing and perforations are made at a desired spacing through the steel liner and into the formation such that hydrocarbons in the desired formation may flow into the oil well bore and from there be produced to the surface.

In the past, perforating gun assemblies have been transported to the oil well site in a disassembled or partially disassembled condition. For safety reasons, the shaped charge perforating units have been transported separate from the detonating devices such that if the detonating devices were accidentally discharged, the shaped charge perforating units would not be detonated in turn.

Attempts have been made to provide a detonating assembly which may be installed in a gun assembly such that the gun assembly can be transported in the fully assembled condition. Such an apparatus is disclosed in U.S. Pat. No. 4,011,815 issued to Jose Garcia Mar. 15, 1977. The apparatus disclosed in the aforementioned patent is not entirely satisfactory in that a passageway is provided which is difficult to adequately seal to prevent well fluids from entering the gun assembly through the detonating apparatus.

In the apparatus disclosed herein, two housing members are provided which are arranged to allow rotatable movement therebetween from a safe position to an armed position. This rotatable movement is provided by applying torque to a bull plug sealed in one end of the tubular charge carrier of the gun assembly.

The detonator of the gun assembly is enclosed in an explosive absorptive cavity, and is further arranged to be aligned with a booster in the detonating train of the well perforator units when the apparatus is in the armed position, and is further arranged to be isolated from the booster when the apparatus is in the safe position. A safety pin means is further provided which further protects the mentioned booster when the apparatus is in the safe position.

If the detonator should be accidentally exploded when the apparatus is in the safe position, the explosion will be absorbed by the housing members and the booster will be covered by the safety pin such that the detonator blast will not be propagated to the booster and the well perforator units will thus not be exploded accidentally.

It can be seen that a well perforating gun assembly is provided which may be transported to the well site in a fully assembled condition and with the detonator assembly in the safe position. After arrival at the well site, the gun assembly may be fully armed by simply rotating a plug at one end of the gun assembly to move the enclosed detonator into alignment with a booster.

Appropriate sealing means is provided between the end plug and the gun assembly such that the end plug may be freely rotated without disturbing the seal between the plug and the gun assembly. Thus, the disclosed gun assembly is protected from invasion of well bore fluids, and the well perforating units and detonator within the gun assembly are desensitized from well bore fluid pressure.

Visual means are also provided to give a visual indication as to whether the gun assembly is in the safe or the armed condition.

DESCRIPTION OF THE PREFERRED EMBODIMENT

Figure 1:
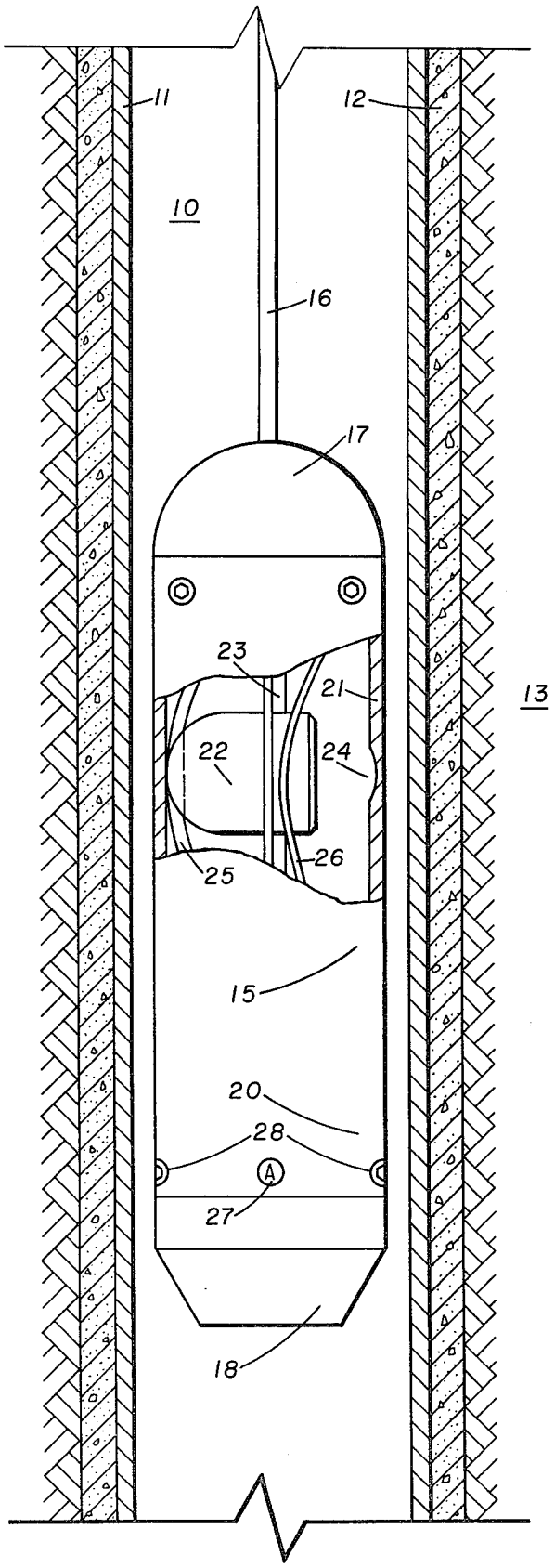
FIG. 1 shows a well perforating gun assembly including the detonator assembly of the present invention in a casing lined well bore prior to the initiation of the well perforating units.

Shown in FIG. 1 is a perforating gun assembly 15 suspended by a wireline 16 in a borehole 10 through a formation to be investigated 13. The borehole 10 is lined by a steel casing 11 cemented into place by cement 12.

The gun assembly 15 includes a firing head 17, a bottom bull plug 18 and a charge carrier 21 which is a tubular member extending between the firing head 17 and the bull plug 18.

The safe/arm detonator assembly 20 of the present invention is at the lower end of charge carrier 21 with one end attached to bull plug 18.

The bull plug 18 is held in place in charge carrier 21 by screws 28.

Shaped charges 22 for performing the perforation operations are held in place by a charge holder 23 which extends from the firing head 17 to the other end of the safe/arm detonator assembly 20. The shaped charges 22 are generally held opposite means in the charge carrier 21 for allowing the shaped charge jet to penetrate the walls of charge carrier 21 and perforate the steel casing 11 and cement 12 into the formation 13. Such a means is illustrated in FIG. 1 by internal recesses 24 which are disclosed in U.S. patent application Ser. No. 758,299 assigned to the assignee of the present invention. Other means, such as external scallops or ports with desired plugs, may be used such that the shaped charge 22 may perforate the charge carrier 21 without forming undesirable burrs, as is known in the art.

The shaped charges 22 are detonated by detonating cord 25 extending throughout the full length of the gun assembly 15. An electrical conductor 26 for energizing the safe/arm detonating assembly to set off the detonating cord extends from the firing head 17 to the detonator assembly 20. The firing head 17 serves to connect the electrical conductor 26 to an electrical conductor in wireline 16 which extends from the firing head 17 upwardly to the surface. This electrical connection is accomplished in firing head 17 while maintaining a fluid tight seal between fluid in well bore 10 and the interior of gun assembly 15. An energizing signal may be impressed from the surface on the electrical conductor in wireline 16 and transferred by firing head 17 to the electrical conductor 26 which in turn activates the detonator assembly 20 to detonate the primacord 25 and the shaped charges 22 in the gun assembly 15.

A visual indicating means 27 is provided in the wall of charge carrier 21 to indicate whether the detonator assembly 20 is set in the safe or armed position. Illustrated in FIG. 1 is the detonator assembly 20 in the armed position as indicated by the letter "A" of visual indication means 27.

Figure 2:
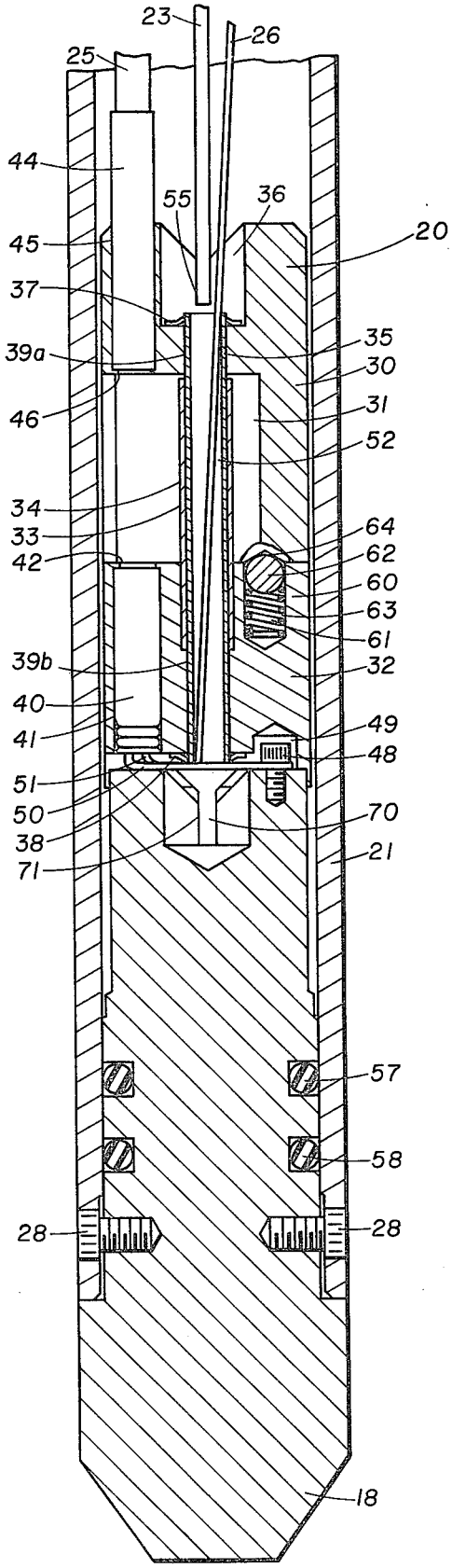
FIG. 2 is a cross-sectional view of the safe/arm detonator assembly of the present invention in the armed position.

Shown in FIG. 2 in the armed position, is the detonator assembly 20 which includes a booster housing 30 having a cutout portion 31, and a detonator housing 32. Between the booster housing and the detonator housing is a shaft means 33 axially aligning the two housings and providing for rotary movement of the two between the safe and armed positions.

In the illustrated embodiment, shaft means 33 has an outer sleeve 34 and an inner sleeve 35 arranged for allowing rotating movement.

The shaft means 33 extends through shaft bore 39*a* in booster housing 30 and shaft bore 39*b* in detonator housing 32, and is held in place at each end by appropriate means such as the retainers 37 and 38 shown at each end of inner shaft 35.

It will be understood that a single shaft could be utilized wherein the shaft is an extension of one of the housings, and extends through and is secured in a bore in the other housing by means which allows rotary movement about the shaft of the two housing sections.

A cavity 36 is provided in the end of booster housing 30 which cavity 36 communicates with the wiring bore 52 through the shaft means 33.

An electric detonator 40 is provided in a detonator bore 41 in the detonator housing 32. The inward end of the detonator bore 41 has a reduced bore to form a lip 42. This lip 42 prevents the electric detonator 40 from being pushed completely through the bore 41 thereby ensuring that the rotary movement between the two housings will not be blocked by the electric detonator 40 extending into the cutout portion 31.

A booster 44 is provided on the end of primacord 25 and is placed in a booster bore 45 in the booster housing 30. The inward end of booster bore 45 has a reduced diameter to form a lip 46 to ensure that the booster 44 will likewise not pass through the bore 45 into the cutout portion 31.

In the armed position shown in FIG. 2, the electric detonator is aligned to be directly across the cutout portion 31 from the booster 44. Thus when the electric detonator 40 is detonated, the blast will be propagated across cutout portion 31 to detonate booster 44 and the attached primacord 25.

A grounding screw 48 is provided in the end of bull plug 18 and has its head extending into a hole 49 in the detonator housing 32. One electrical conductor 50 from the detonator 40 extends to and is secured by grounding screw 48 to form one-half of the electrical circuit with the body of the gun assembly 15 and the armor strands of wireline 16.

The other half of the electrical circuit is provided by the second conductor 51 from the detonator 40 extending to conductor 26 which passes through the wiring bore 52 of the shaft means 33, the cavity 36 in the booster housing 30, and to the firing head 17. The detonator 40 is set off in a conventional manner by an electrical potential at the surface between the electrical conductor in wireline 16 and the armored cables of the wireline 16.

A slot 55 in the end of booster housing 30 receives the end of charge holder 23. The opposite end of charge holder 23 is secured in firing head assembly 17 by an appropriate means such that the booster housing 30 is held in a fixed position in relation to charge carrier 21. Attachment means, part of which is shown at 70, are provided in the end of detonator housing 32 and inserted into an appropriate slot 71 in bull plug 18 for securing the lower end of detonator housing 32 to the bull plug 18. Sealing means, such as O-rings 57 and 58, are provided in bull plug 18 to form a fluid tight seal between the walls of bull plug 18 and the interior walls of charge carrier 21 to seal fluid in well bore 10 from the interior of the gun assembly 15.

It can thus be seen that when screws 28 are removed from bull plug 18, torque may be applied to bull plug 18 to rotate the bull plug 18 and the detonator housing 32 secured thereto. This rotation will be with respect to the charge carrier 21 and the booster housing 30 which is held in place by the action of charge holder 23 in the slot 55.

Screws 28 and corresponding threaded holes in bull plug 18 are spaced or otherwise arranged such that the screws 28 may be threaded into bull plug 18 when the detonating assembly 20 is both in the armed position and the safe position.

Detent means 60, shown out of place in FIG. 2 for clarity, is provided between detonator housing 32 and booster housing 30 to align detonator bore 41 and booster bore 45 when assembly 20 is in the armed position. The detent means 60 also gives a positive indication when the assembly 20 has reached either the safe or armed positions.

The detent means 60 includes a detent spring 61 and a detent ball 62 in detent hole 63 in the detonator housing 32. A detent recess 64 is shown in booster housing 30 for the armed position.

Figure 3:
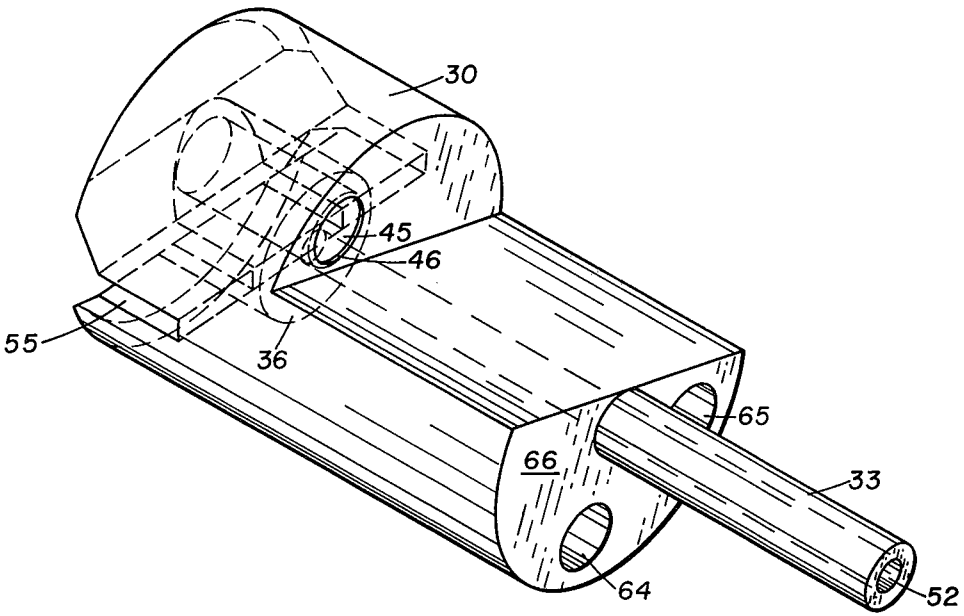
FIG. 3 is an isometric view of one of the housing members of the detonator assembly of the present invention.

FIG. 3 is an isometric view of the booster housing with the cavity 36, the slot 55, the booster bore 45 and the wiring bore 52 shown as hidden lines. The inward face 66 of the booster housing is shown with the fire detent recess 64 and the safe detent recess 65 in their respective locations.

When the bull plug 18 and the attached detonator housing 32 are rotated in the clockwise direction from the safe position to the armed position, the detent ball 62 is cammed out of the safe detent recess 65 and moved to the armed detent recess 64 where, when seated, aligns the bore 41 with the bore 45.

When counter-clockwise torque is applied to bull plug 18, the detent ball 62 is cammed out of the armed detent recess 64 and moved back to the safe detent recess 65. When the detonator assembly 20 is in the safe position, the booster 40 within booster bore 41 is moved behind the inward face 66 of the booster housing 30 such that if the detonator 40 was accidentally exploded, the blast from the detonator 40 would be into the face 66 of the booster housing 30.

Figure 4:
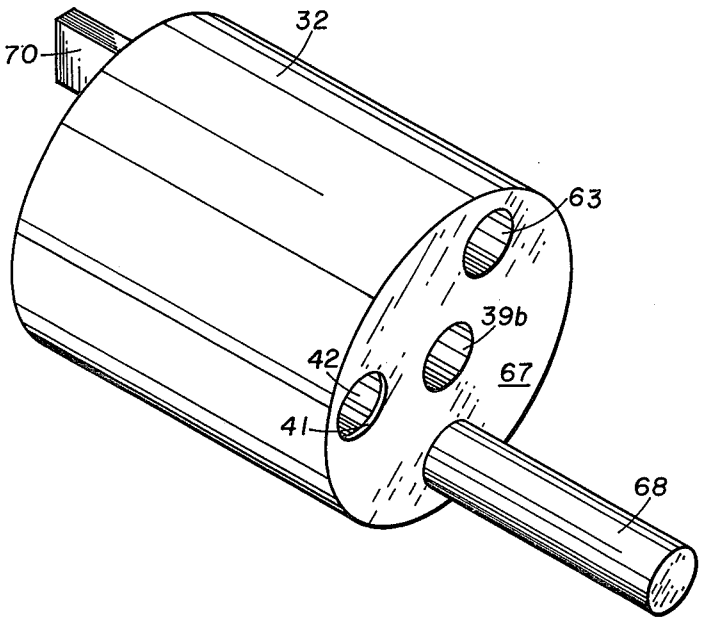
FIG. 4 is an isometric view of the other housing member of the detonator assembly of the present invention.

The detonator housing 32 is shown in an isometric view in FIG. 4 showing the inward face 67 of the detonator housing 32. Also shown is the end of bore **39*b* for receiving shaft means 33, detent hole 63 for receiving the detent assembly 60, and the end of detonator bore 42 with its retaining lip 41**.

A safety pin 68 extends from the inward face 67 of the detonator housing 32 and is positioned such that when the assembly 20 is rotated to the safe position, safety pin 68 in the cutout portion 31 covers the end of booster bore 45.

Figure 5:
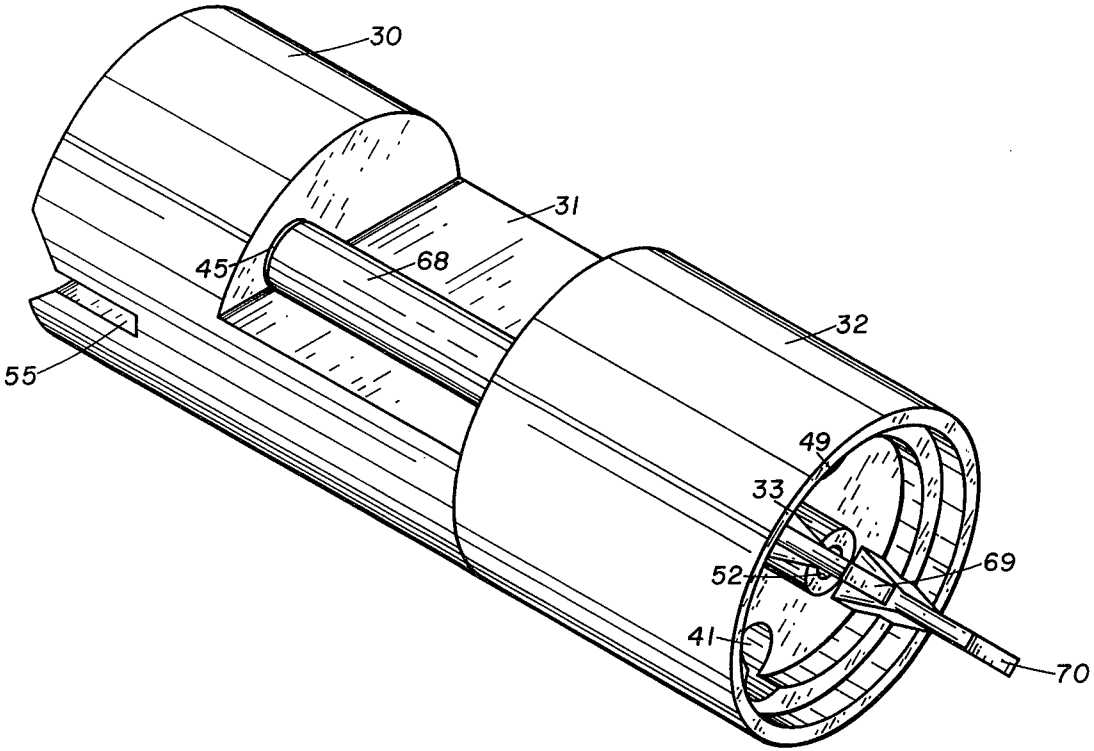
FIG. 5 is an isometric view of the two housing members of the present invention in the assembled condition with the housing members shown in the safe position.

The positioning of safety pin 68 may be seen more clearly in FIG. 5 which shows the safe/arm detonator assembly 20 in the safe position. As can be seen, in this position the safety pin 68 extends from detonator housing 32 across cutout portion 31 and covers the end of booster bore 45. It will be remembered that in this position the inward end of detonator bore 41 is behind the face 66 of the inward end of booster housing 30. Thus if the detonator 40 in bore 41 is accidentally exploded while the assembly 20 is in the safe position, the blast from the detonator 40 will be absorbed by the inward face 66 of the housing 30 and the booster in bore 45 will be further protected by safety pin 68 which covers the end of booster bore 45. The safety pin 68 is further made of a suitable material, such as steel, which will shield the booster 44 from the effects of the blast.

The booster housing 30 and the detonator housing 32 may be metal, or may be formed in plastic such as phenolic. The shaft means 33 may be made of metal or some other suitable material to ensure that the housings 30 and 32 properly rotate in alignment with each other.

It will be understood that when the detonator housing 32 is rotated clockwise with respect to booster housing 30, the safety pin 68 will be rotated to the other side of cutout portion 31 and booster 40 in bore 41 will be moved into alignment with booster 44 in bore 45.

Shown in FIG. 5, are attachment means such as fins 69 and 70 which extend from the end of detonator housing 32 and may be plugged into appropriate recesses in the end of bull plug 18. These attachment means may further be polarized, for instance by making one fin longer or larger than the other fin, to ensure that the apparatus may be assembled only in the correct orientation so that the visual indicating means 27 will only indicate that the assembly 20 is in the safe position when the detonator 40 is in fact behind the face 66 and the safety pin 68 covers the end of booster bore 45.

When ready to arm the gun assembly 15 for lowering into a borehole, screws 28 are removed and torque is applied to the bull plug 18 to rotate the housings 30 and 32 from the safe position shown in FIG. 5 to the armed position shown in FIG. 2. During this rotation, the detonator 40 in detonator bore 41 is rotated from behind face 66 into the cutout portion 31. Alignment with the booster in booster bore 45 is accomplished by detent ball 62 moving into recess 64 by the action of spring 61. The visual indicating means 27 at this point is arranged to show that the gun assembly 15 is in the armed position. The screws 28 may then be reinserted into the bull plug 18 and the gun assembly is fully armed and ready for lowering into a well bore for perforation.

It can thus be seen that a safe/arm detonator assembly is disclosed which may be moved between the safe and armed positions without disturbing the seal between the exterior and the interior of the gun assembly. It can also be seen that a safe/arm assembly is provided that may be transported from place to place in the safe position, and then quickly moved to the armed position without having to disassemble and reassemble the gun assembly.

The embodiments disclosed herein are intended to be illustrative only, and those skilled in the art may visualize other equivalent embodiments. These equivalent embodiments are intended to be covered by the following claims:

What is claimed is:

1. A well perforating gun assembly comprising:

a tubular charge carrier for carrying oil well perforating units;

a plug means for sealingly plugging one end of said tubular charge carrier while allowing rotatable movement between said charge carrier and said plug means;

a first housing member connected to one of said charge carrier and said plug means;

a second housing member connected to the other of said charge carrier and said plug means and rotatable with respect to said first housing member between a safe position and an armed position;

a detonator holding means in one of said housing members rotatable with said housing member;

a booster holding means in the other of said housing members and rotatable with said housing member into alignment with said detonator holding means in the armed position, and rotatable out of alignment with said detonator holding means in the safe position;

a detonator in said detonator holding means; and a booster in said booster holding means for activating said well perforating units by exploding.

2. The well perforating gun assembly of claim 1 wherein said booster holding means and said detonator holding means are bores in said housing members; and further comprising means for axially aligning said bores when the housing members are in the armed position such that the blast from one end of said detonator is directed into one end of said booster.

3. The gun assembly of claim 2 wherein said housing members have faces on their respective ends facing one another and rotatable with said housing members for moving said one end of said detonator in one of the housing members behind the face of the other of the housing members when said housing members are moved to the safe position.

4. The well perforating gun assembly of claim 2 wherein said means for axially aligning said bores includes detent means for resiliently holding said housing members in alignment when said housing members are in the armed position; said detent means further arranged for holding said housing members in the safe position when said housing members are rotated to the safe position.

5. The well perforating gun assembly of claim 2 wherein one of said housing members has a cutout portion;

and said assembly further comprises safety pin means on the other housing member and extending into said cutout portion and arranged such that when said housing members are rotated to the safe position, said safety pin covers said one end of said booster, and when the housing members are rotated to the armed position said safety pin uncovers said one end of said booster such that the blast from said one end of said detonator may be propagated across said cutout portion to said one end of said booster.

6. The well perforating gun assembly of claim 5 further comprising visual indicating means arranged between said plugging means and said charge carrier for visually indicating when said housing members are in the armed position, and for further indicating when said housing members are in the safe position.

7. A detonating assembly comprising:

two housing members axially aligned with one another, the first of said housing members having a bore therethrough for a detonator, and the second of said housing members having a bore therethrough for a booster;

axial shaft means through the center axis of said housing members for allowing rotatable movement between said housing members around said shaft means from a safe position wherein said bores in said members are not aligned, to an armed position wherein said bores in said members are aligned;

one of said housing members having a cutout portion; and safety pin means on the other housing member and extending into said cutout portion and arranged such that when said housing members are rotated to the safe position, said safety pin covers one end of said booster bore, and when the housing members are rotated to the armed position said safety pin uncovers said one end of said booster bore such that a blast from a detonator in said detonator bore may be propagated across said cutout portion into said one end of said booster bore.

8. The detonating assembly of claim 7 wherein said housing members have faces on their respective ends facing one another:

and rotatable with said housing members for moving said one end of said detonator bore behind the end face of one of said housing members when said housing members are rotated to the safe position; and means for holding said bores in alignment when said housing members are in the armed position.

9. The detonating assembly of claim 8 wherein said means for holding said bores in alignment includes detent means for resiliently holding said housing members in alignment when said housing members are in the armed position; said detent means further arranged for holding said housing members in the safe position when said housing members are rotated to the safe position.

10. The detonating assembly of claim 7 wherein said one end of said detonator bore and said one end of said booster bore each have reduced diameters to form lips to retain a booster and a detonator within said bores for preventing movement past said reduced diameter bores into said cutout portions while allowing a blast from a detonator in said detonator bore to propagate out of said one end of said detonator bore through its reduced diameter bore, and into said one end of said booster bore through its reduced diameter bore to initiate detonation of a booster therein.

11. The detonator assembly of claim 10 wherein said shaft means has an axial bore therethrough for passing an electrical conductor from one side of the housing members to a second end of said detonator bore on the opposite side of said housing members for electrical connection with an electrical detonator within said detonator bore.

12. The detonator assembly of claim 10 wherein said housing members are made of an explosion absorptive material for absorbing the blast of a detonator if a detonator in said detonator bore is exploded when said housing members are in the safe position.

13. The detonator assembly of claim 10 further comprising means on one of said housing members for activating a visual indicating means for indicating when the housing members are in an armed position and a safe position.

14. The detonator assembly of claim 13 wherein said visual indicating activating means includes polarizing means for allowing said housing members to be connected to said visual indicating means in only one way.

* * * * *